US010645485B2

(12) United States Patent
Chang

(10) Patent No.: US 10,645,485 B2
(45) Date of Patent: May 5, 2020

(54) EXTENSION SYSTEM OF WOOFER AND DESIGN METHOD THEREOF

(71) Applicant: Acer Incorporated, New Taipei (TW)

(72) Inventor: Jia-Ren Chang, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 15/990,678

(22) Filed: May 27, 2018

(65) Prior Publication Data

US 2019/0246200 A1 Aug. 8, 2019

(30) Foreign Application Priority Data

Feb. 7, 2018 (TW) ..... 107104379 A

(51) Int. Cl.
*H04R 1/28* (2006.01)

(52) U.S. Cl.
CPC ..... *H04R 1/2819* (2013.01); *H04R 1/2842* (2013.01); *H04R 1/2857* (2013.01); *H04R 2499/11* (2013.01); *H04R 2499/15* (2013.01)

(58) Field of Classification Search
None
See application file for complete search history.

(56) References Cited

U.S. PATENT DOCUMENTS

| | | | |
|---|---|---|---|
| 2004/0240698 | A1 | 12/2004 | Eaton |
| 2018/0007465 | A1 | 1/2018 | Liu et al. |

FOREIGN PATENT DOCUMENTS

| | | |
|---|---|---|
| CN | 1942020 | 4/2007 |
| CN | 101873771 | 10/2010 |
| CN | 102938869 | 2/2013 |
| CN | 103782610 | 5/2014 |
| CN | 106134223 | 11/2016 |
| CN | 106658270 | 5/2017 |
| CN | 106714045 | 5/2017 |
| CN | 107147975 | 9/2017 |
| CN | 107547992 | 1/2018 |
| EP | 2282553 | 2/2011 |
| EP | 3242492 | 11/2017 |
| JP | 2000050377 | 2/2000 |
| TW | 201801540 | 1/2018 |

*Primary Examiner* — Kenny H Truong
(74) *Attorney, Agent, or Firm* — JCIPRNET

(57) ABSTRACT

An extension system of a woofer suited for a portable electronic device is provided. The extension system of woofer includes the woofer, a front channel, and a rear channel disposed in a body of the portable electronic device. The rear channel is a sealed space, a volume of the front channel is greater than a volume of the rear channel, and the front channel has a bass hole formed on a surface the body. A design method of an extension system of a woofer is also provided.

7 Claims, 13 Drawing Sheets

EXTENSION SYSTEM OF WOOFER AND DESIGN METHOD THEREOF

CROSS-REFERENCE TO RELATED APPLICATION

This application claims the priority benefit of Taiwan application serial no. 107104379, filed on Feb. 7, 2018. The entirety of the above-mentioned patent application is hereby incorporated by reference herein and made a part of this specification.

BACKGROUND OF THE DISCLOSURE

1 Field of the Disclosure

The disclosure relates to an extension system of a woofer and a design method thereof.

2. Description of Related Art

Micro-speakers have a broad applicability, and are mounted in various portable electronic devices to play music or sound effects. However, to meet the users' needs of making electronic devices more convenient to carry around, electronic devices are being developed to be thinner, and speakers inside the devices also need to be thinner. However, if the volume of a mobile phone is reduced, such reduction may affect the performance of the speaker module of the mobile phone. For example, the volume of a channel of the speaker module is closely related to the output sound quality. Currently, the industry finds that the woofer sound effect may be significantly affected as the speaker becomes thinner. In general, in spite of various attempts, woofer sounds are normally no lower than 600 Hz, and a woofer sound lower than 600 Hz is unable to be conveyed. Therefore, the user's listening experience is less satisfactory.

Particularly, regarding tablet computers, the thickness of the bodies thereof is generally limited. Therefore, the design conditions of the speakers and the channels thereof are further limited. Under such limited conditions, how to further facilitate the woofer sound performance of the speaker remains an issue to work on.

SUMMARY OF THE DISCLOSURE

One or some exemplary embodiments of the disclosure provides an extension system of a woofer and a design method of an extension system of a woofer capable of generating a woofer sound effect when a size of a device body is limited.

A design method of an extension system of a woofer according to an embodiment of the disclosure is adapted for a portable electronic device and includes the following. A predetermined volume required for installing the extension system to the portable electronic device is obtained. A cut-off frequency is computed based on the predetermined volume and a wave formula of plane waves. A channel length and a channel cross-sectional area of the extension system are obtained through the computing. A front channel of the extension system is formed according to the channel length and the channel cross-sectional area, and the extension system is fit into the portable electronic device.

An extension system of a woofer according to an embodiment of the disclosure is adapted for a portable electronic device. The extension system of the woofer may include the woofer, a front channel, and a rear channel respectively disposed in a body of the portable electronic device. The rear channel is a sealed space, a volume of the front channel is greater than a volume of the rear channel, and the front channel has a bass hole formed on a surface of the body.

Based on the above, the predetermined space of the extension system of the woofer to be disposed in the electronic device is obtained. Then, according to the embodiments of the disclosure, the cut-off frequency (i.e., the woofer resonant frequency) is computed based on the wave formula of plane waves, and the channel length and the channel cross-sectional area of the extension system are further obtained through computation. In addition, the channel length and the channel cross-sectional area may form the front channel of the extension system in the body of the portable electronic device. Meanwhile, the volume of the rear channel is obtained based on the specification of the woofer, wherein the volume of the front channel is greater than the volume of the rear channel. Then, the front channel and the rear channel are fit into the device according to the components of the body, so as to accomplish the extension system of the woofer. Accordingly, the extension system of the woofer may still be designed in a portable electronic device, such as a tablet computer, even when the device conditions (e.g., size and arrangement) of the portable electronic device are limited. In other words, even under a critical space usage condition inside the body, the extension system may still be disposed to allow the portable electronic device to play woofer sounds, thereby facilitating the user's experience of operating the portable electronic device.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
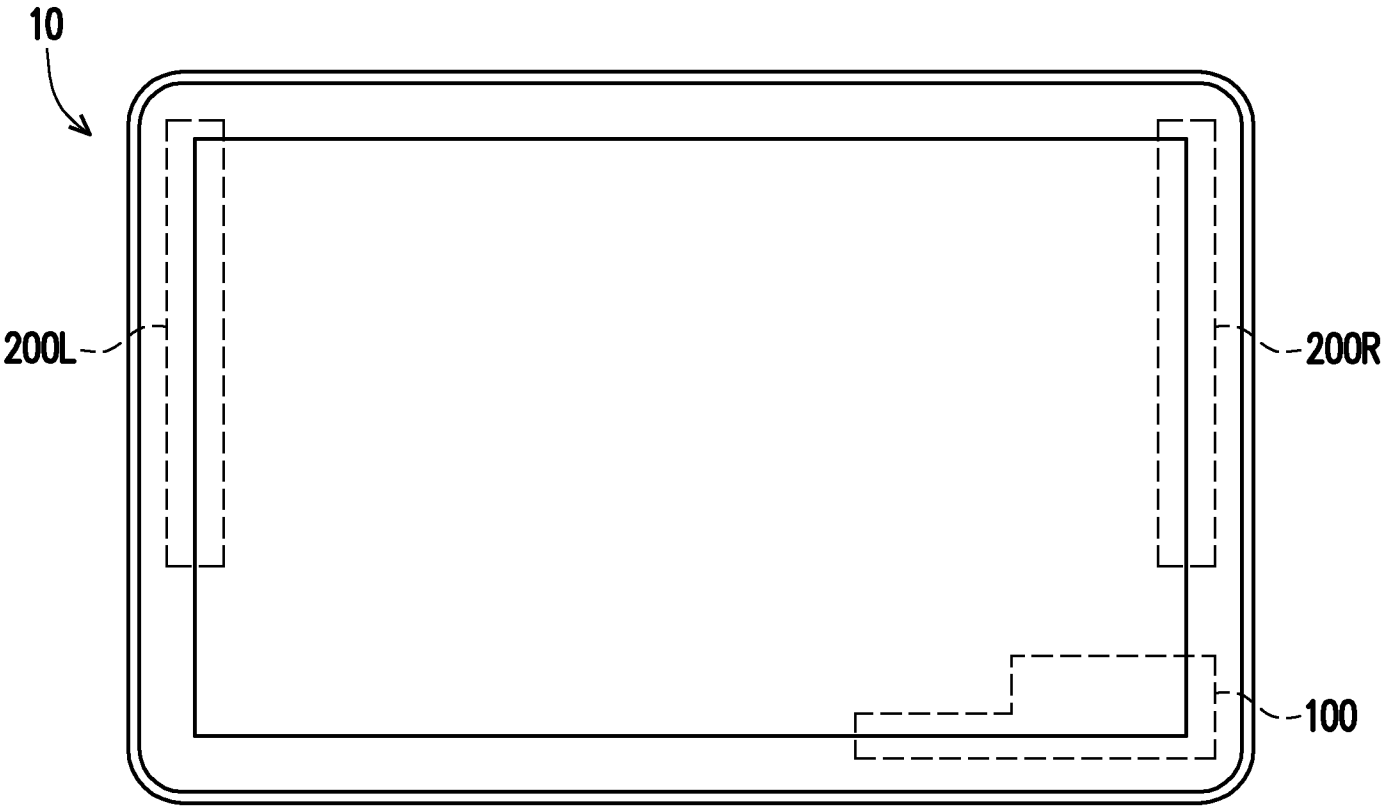
FIG. 1 is a schematic front view illustrating a portable electronic device according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 2:
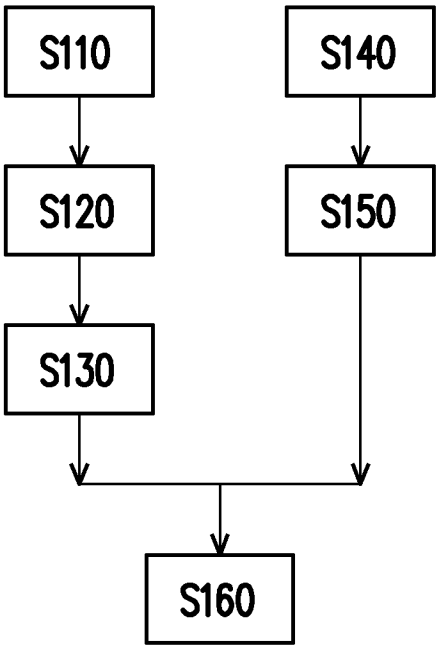
FIG. 2 is a flowchart illustrating a design method of an extension system of a woofer of the disclosure.

FIG. 1 is a schematic front view illustrating a portable electronic device according to an embodiment of the disclosure. FIG. 2 is a flowchart illustrating a design method of an extension system of a woofer of the disclosure. Referring to FIGS. 1 and 2, in the embodiment, the design method of the extension system of the woofer is adapted for a portable electronic device. Taking a tablet computer as an example, the tablet computer has a body 10 and a speaker module disposed inside the body 10. The speaker module includes an extension system 100 of the woofer, a left channel speaker system 200L and a right channel speaker system 200R. Here, the left channel speaker system 200L and the right channel speaker system 200R are as taught in the known art and handle sounds at medium and high frequencies. Therefore, details in this regard will not be further described in the following. As we know that, the portable electronic device is limited of its inner space for disposing the woofer.

In the embodiment, in order for the woofer to be disposed in the tablet computer shown in FIG. 1, the specific characteristic (the design method) according to the embodiments of the disclosure is needed. First of all, at Step S110, a predetermined space for installing the extension system 100 of the woofer to the portable electronic device is obtained. Then, at Step S120, a cut-off frequency for the predetermined space is computed based on a wave formula of plane waves. Here, the cut-off frequency is a resonance frequency of desired woofer sounds. In the embodiment, the cut-off frequency is greater than or equal to 250 Hz. Accordingly, a channel size, i.e., the length and the cross-sectional area of the channel, for transmission of the woofer sounds is obtained at Step S130. Meanwhile, in other steps (Step S140 and Step S150), a volume of a rear channel of the woofer may be set by obtaining the specification of the woofer. Then, at Step S160, the channel size is applied to a front channel of the extension system, and the channel size and the volume of the rear channel are fit together into the body 10 of the portable electronic device. Meanwhile, a bass hole of the front channel is formed on a surface of the body 10, and a space where the rear channel is located is a sealed space. Accordingly, the extension system 100 of the woofer of the embodiment is completed. It should be noted that the fitting process refers to a process adapted to cope with differences in configuration conditions (e.g., the internal space and peripheral components of the body 10) in the body 10.

According to the above, unlike the known woofer extension technology adopting the rear channel structure to transmit the woofer sounds, the embodiments of the disclosure use the wave formula of plane waves and peripheral setting conditions thereof instead. Therefore, the woofer is freed from a rear channel with a greater volume (thickness) required in the known art (e.g., those adopting a vented port) to transmit woofer sounds. Therefore, the embodiments of the disclosure are able to provide a woofer sound effect under a limited space condition in a thin electronic device.

To be more specific, the design is based on an equation as follows: $f_p=[(2m+1)\times C]/4L$, wherein $f_p$ represents low-frequency resonant frequency, C represents sound speed (in the unit of m/s), L represents length of a waveguide tube, which may be considered as a channel length or a distance that the woofer sound is transmitted from the speaker to an audio out. In addition, m=0, 1, 2, . . . , represents mode of vibration.

FIGS. 3A to 3D and FIGS. 4A and 4D are different extension systems obtained according to the design method.

Referring to FIGS. 3A to 3D, here, only a portion of the body 10 occupied by the extension system 100 of the woofer is shown for an illustrative purpose. In the embodiment, the extension system 100 of the woofer disposed in the body 10 includes a woofer 110, a front channel F1, and a rear channel R1. The front channel F1 and the rear channel R1 are defined on the basis of the woofer 110. The front channel F1 is adapted to directly transmit sounds (acoustic waves) generated by the woofer 110, and the front channel F1 has a bass hole 140 formed on the surface of the body 10 to transmit the sound generated by the woofer 110 out of the body 10. The rear channel R1 is a sealed space adapted for resonance of the acoustic waves generated by the woofer 110 and for the resonated acoustic waves to also be transmitted out of the body 10 through the front channel F1 and the bass hole 140.

The rear channel R1 further includes a space 120A and a space 120B. In addition, the woofer 110 is disposed on a side of the space 120A, and the space 120A is located between the space 120B and the woofer 110. The front channel F1 includes a space 130A and a channel 130B. In addition, the woofer 110 intervenes between the space 120A and the space 130A, and the sounds generated by the woofer 110 and the sounds resonated in the rear channels R1 are transmitted out of the body 10 through the space 130A, the channel 130B, and the bass hole 140.

Figure 5A:
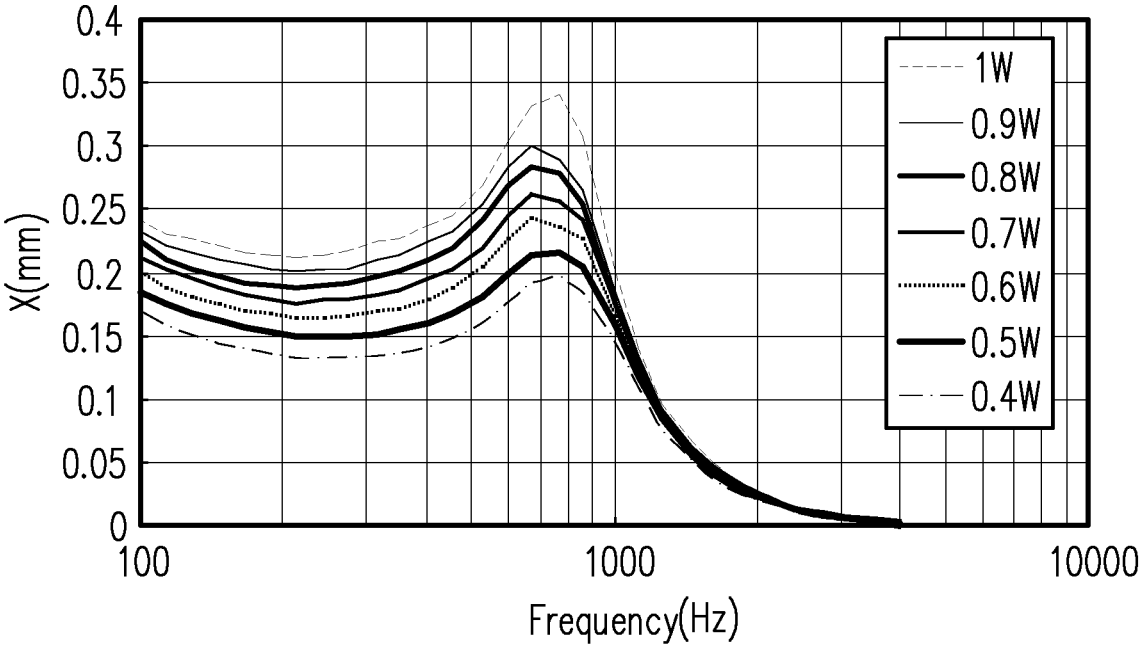
FIG. 5A is a diagram illustrating a relation between diaphragm amplitude and power of a woofer.
Figure 5B:
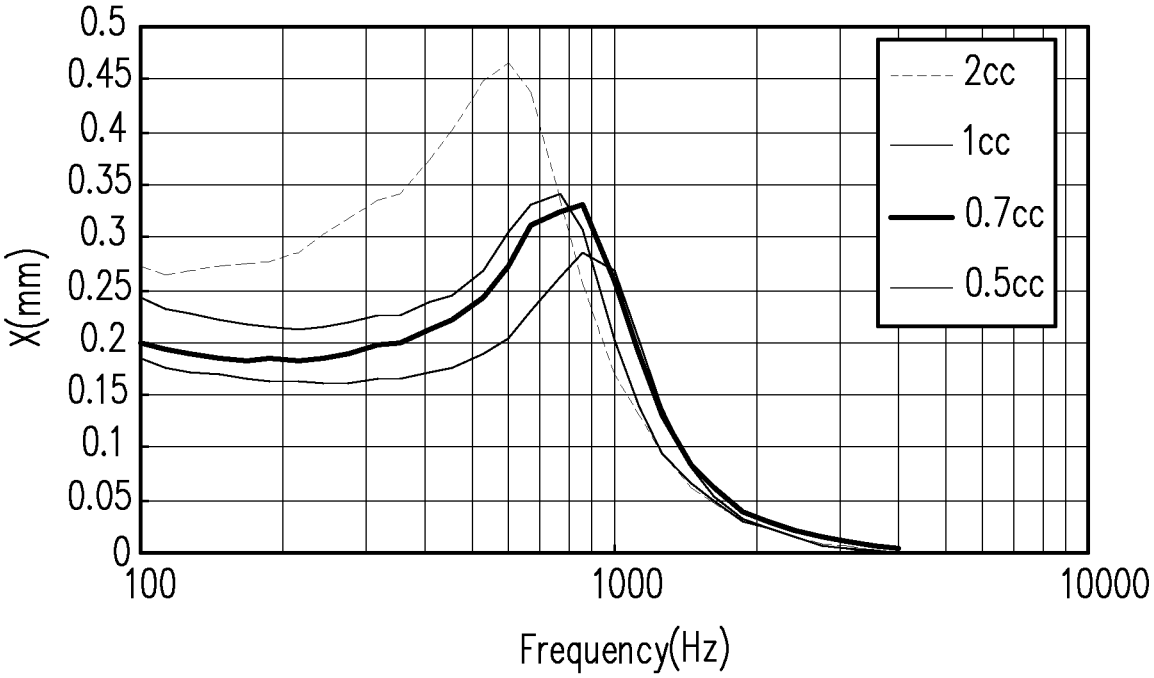
FIG. 5B is a diagram illustrating a relation between diaphragm amplitude and volume of a rear channel.

According to Step S140 and S150 above, the volume of the rear channel R1 depends on the specification of the woofer 110. Here, the woofer 110 suitable for the embodiment includes those whose power is less than equal to 2 w and having dimensions (length×width) of 16 mm×9 mm, 32 mm×9 mm, or 34 mm×11 mm. Accordingly, the rear channel R1 may achieve acoustic wave resonance with a smaller volume. FIG. 5A is a diagram illustrating a relation between diaphragm amplitude and power of a woofer. FIG. 5B is a diagram illustrating a relation between diaphragm amplitude and volume of a rear channel. Referring to FIGS. 5A and 5B, as shown in FIG. 5A, the diaphragm amplitude (when activated from 500 Hz to 700 Hz) of a woofer having the power of 1 W may reach about 0.3 mm to 0.35 mm, and when the volume of the rear channel of the woofer whose power is 1 W is set as 2 c.c, the resonated acoustic waves may render the diaphragm amplitude of the woofer to exceed 0.45 mm. In other words, the volume of the rear channel of the woofer whose power is 1 w should be practically less than equal to 2 c.c, or the woofer may be damaged due to the diaphragm amplitude of the woofer exceeding its capability. Accordingly, the volume of the rear channel R1 of the embodiment after the setting at Step S140 and Step 150 should be less than 3 c.c. In some embodiments, the volume of the rear channel corresponding to the dimensions (length×width) of 16 mm×9 mm is 1 c.c, the volume of the rear channel corresponding to the dimensions (length×width) of 32 mm×9 mm is 2 c.c, and the volume of the rear channel corresponding to the dimensions (length×width) of 34 mm×11 mm is 2 c.c. It should be noted that the volumes of the rear channel are upper limits.

Figure 3A:
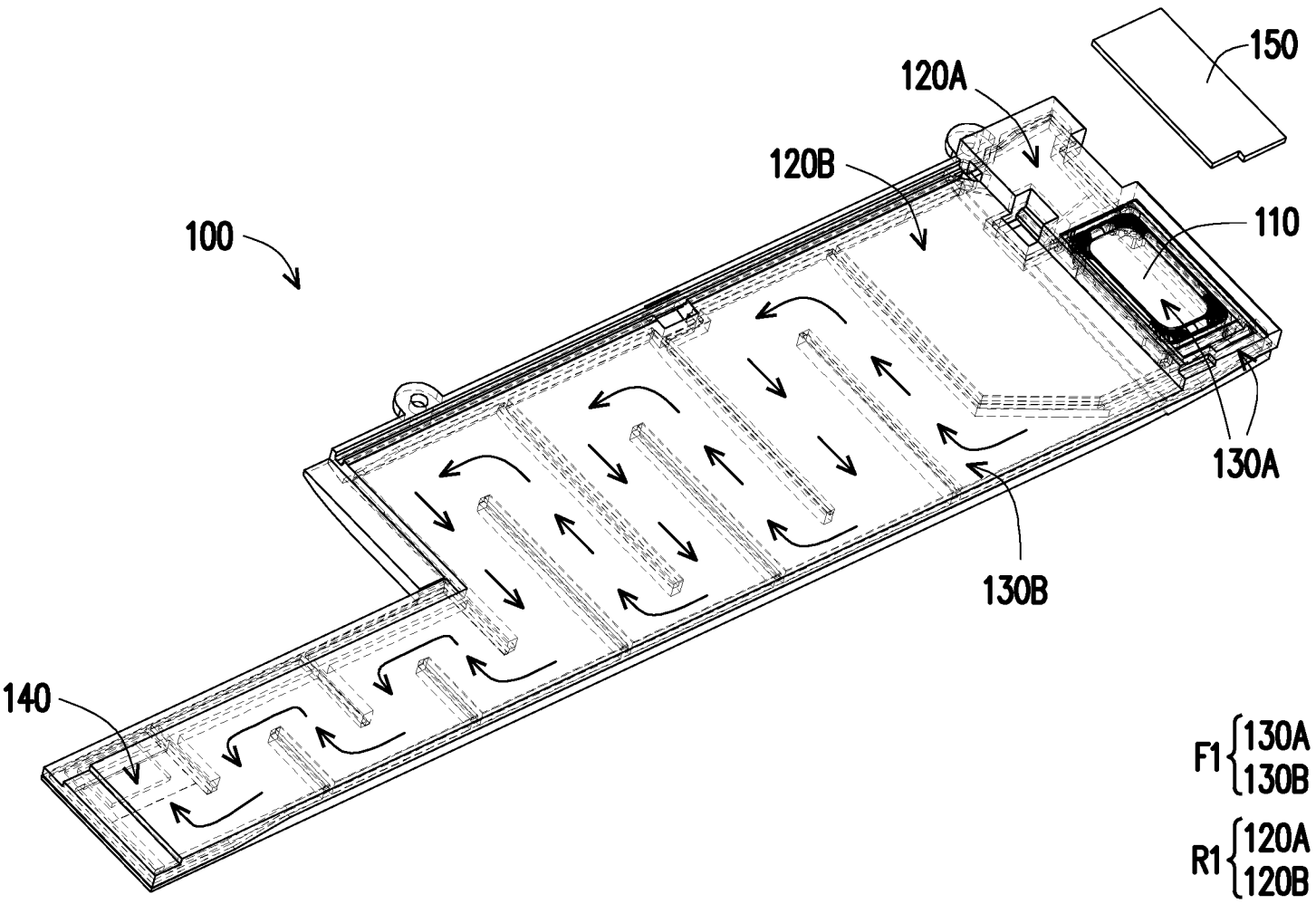
FIGS. 3A to 3D and FIGS. 4A to 4D are different extension systems obtained according to the design method.

Then, referring to the steps and FIGS. 3A to 3D, the woofer 110 whose dimensions (length×width) are 16 mm×9 mm and whose thickness is 3 mm or 2.5 mm is described herein as an example, and the volume of the rear channel R1 may be set as 1 c.c. Then, dimensions of the predetermined space obtained at Step S110 are 133.92 mm×33 mm×5.13 mm, and the thickness of 5.13 mm is described as an example based on the range that the thickness of the body 10 does not exceed 10 mm. Accordingly, the channel size obtained at Step 130 is that the channel length is 291.65 mm, and the channel cross-sectional area is 13 $mm^2$. Therefore, when the channel size is fit into the body 10 of the embodiment, the channel 130B needs to be disposed in a bent arrangement, as shown in FIG. 3A, where the arrow signs indicate the transmission direction of the acoustic waves. Accordingly, an equivalent volume of the channel 130B of the front channel F1 is 3.53 c.c, the volume of the space 130A is 0.18 c.c, and the volume of the front channel F1 formed accordingly is 3.71 c.c. In addition, the volume of the rear channel R1 is set at 1 c.c. Therefore, a total volume required by the extension system 100 of the woofer of the embodiment is 4.71 c.c, and the extension system 100 is able to be disposed in the body 10 of the portable electronic device based on the configuration shown in FIG. 3.

Figure 3B:
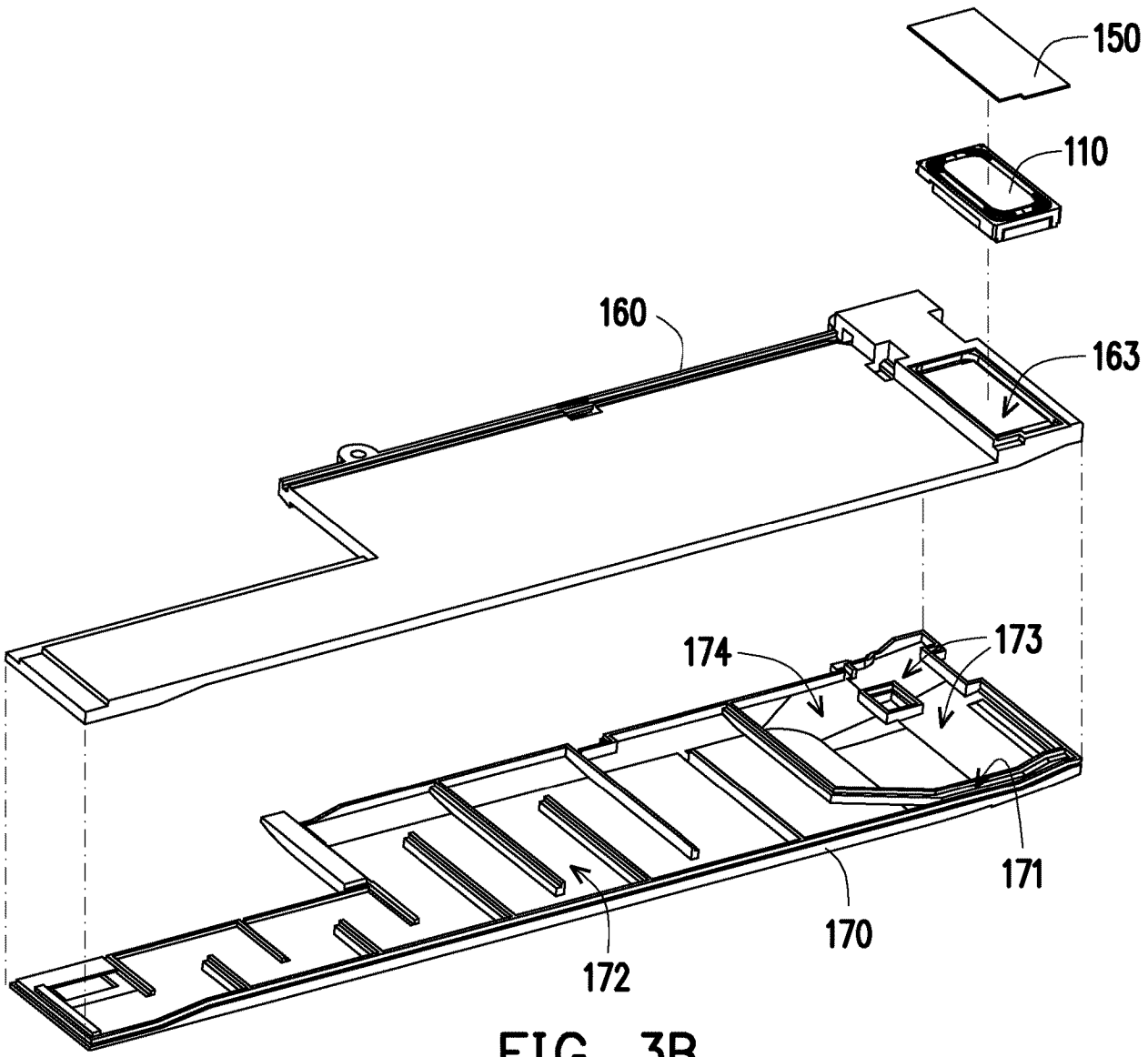
Figure 3C:
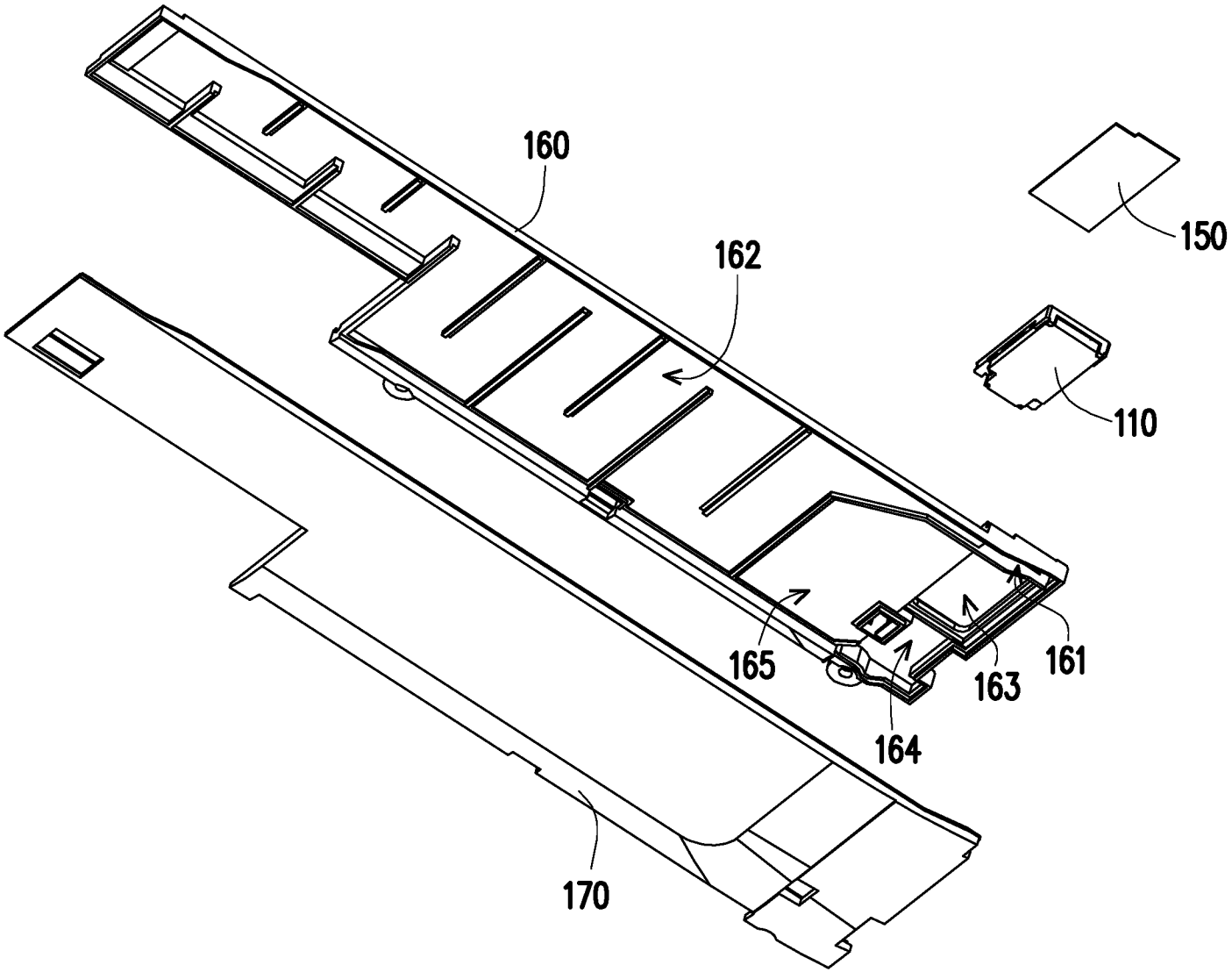
Figure 3D:
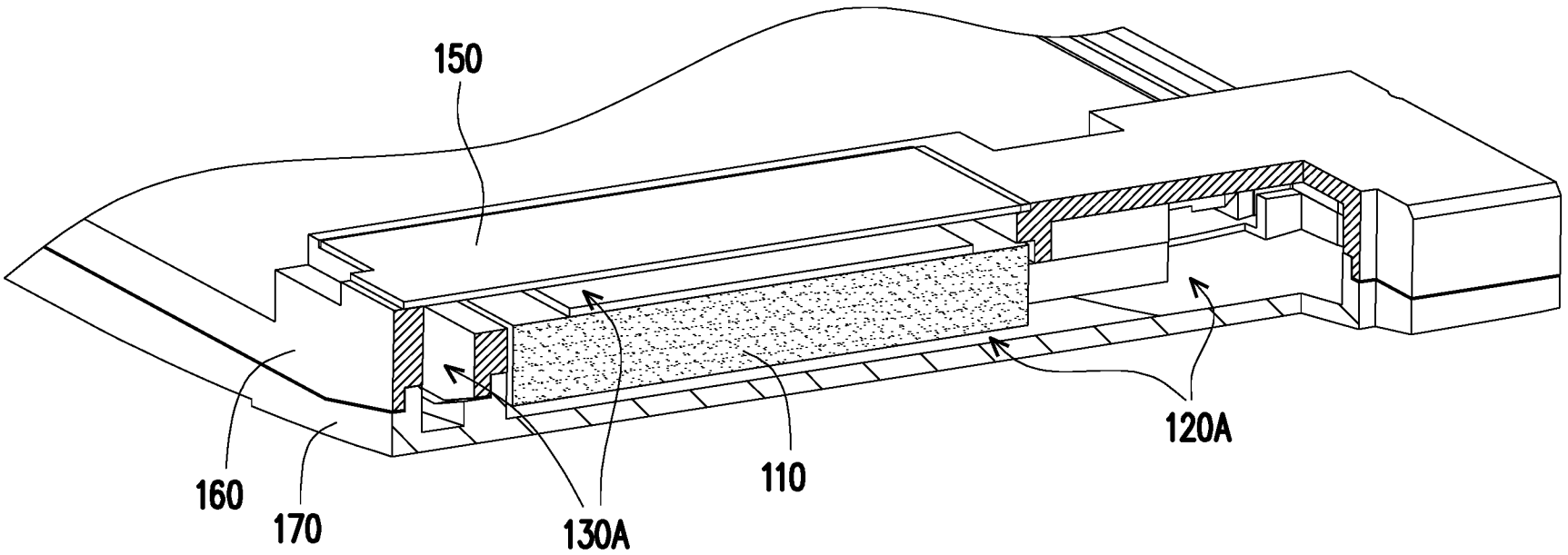

Specifically, FIGS. 3B and 3C are views illustrating structural configurations of the extension system 100 of the woofer from different perspectives, and FIG. 3D is a partial cross-sectional view of the extension system 100. In the embodiment, the extension system 100 includes an upper case 160, a lower case 170, and a cover plate 150. The woofer 110 is accommodated in a space between the upper case 160 and the lower case 170 via an opening 163 of the upper case and covered by the cover plate 150. In addition, a space is kept between the cover plate 150 and the woofer 110. In addition, the upper case 160 includes a plurality of sub-spaces 161, 162, 164, and 165, and the lower case 170 correspondingly includes a plurality of sub-spaces 171 to 174. After the upper case 160 is assembled to the lower case 170, the sub-spaces 162 and 172 are combined to form the channel 130B, the sub-spaces 161 and 171 are combined to form a portion of the space 130A, and the space between the cover plate 150 and the woofer 110 becomes another portion of the space 130A, as shown in FIG. 3D. Accordingly, the space 130A and the channel 130B may form the front channel F1. Besides, the sub-space 173 is located below the woofer 110, and the sub-space 146 and a portion of the sub-space 173 form the space 120A, as shown in FIG. 3D. In addition, the sub-space 174 and the sub-space 165 form the space 120B. Accordingly, the spaces 120A and 120B form the rear channel R1.

Referring to FIG. 4A to 4D, in an extension system 300 of the woofer of the embodiment, a woofer 310 and the woofer 110 have the same specification, and a volume of a rear channel 320 is also set as 1 c.c, like the rear channel R1, but the configuration is different due to the predetermined space of 136.3 mm×31.3 mm×4.96 mm. In the embodiment, a volume of a space 330A obtained accordingly is 0.13 c.c, and a length and a cross-sectional area of a channel 330B are respectively 188.23 mm and 19.5 $mm^2$. Therefore, an equivalent volume of the channel 330B is 2.8 c.c, and the channel 330B and the space 300A form the front channel. Together with the rear channel 320, a total volume required by the extension system 300 of the woofer of the embodiment is 3.93 c.c, and the front channel (the space 300A and the channel 330B) and the rear channel are substantially located on the same plane.

Figure 4A:
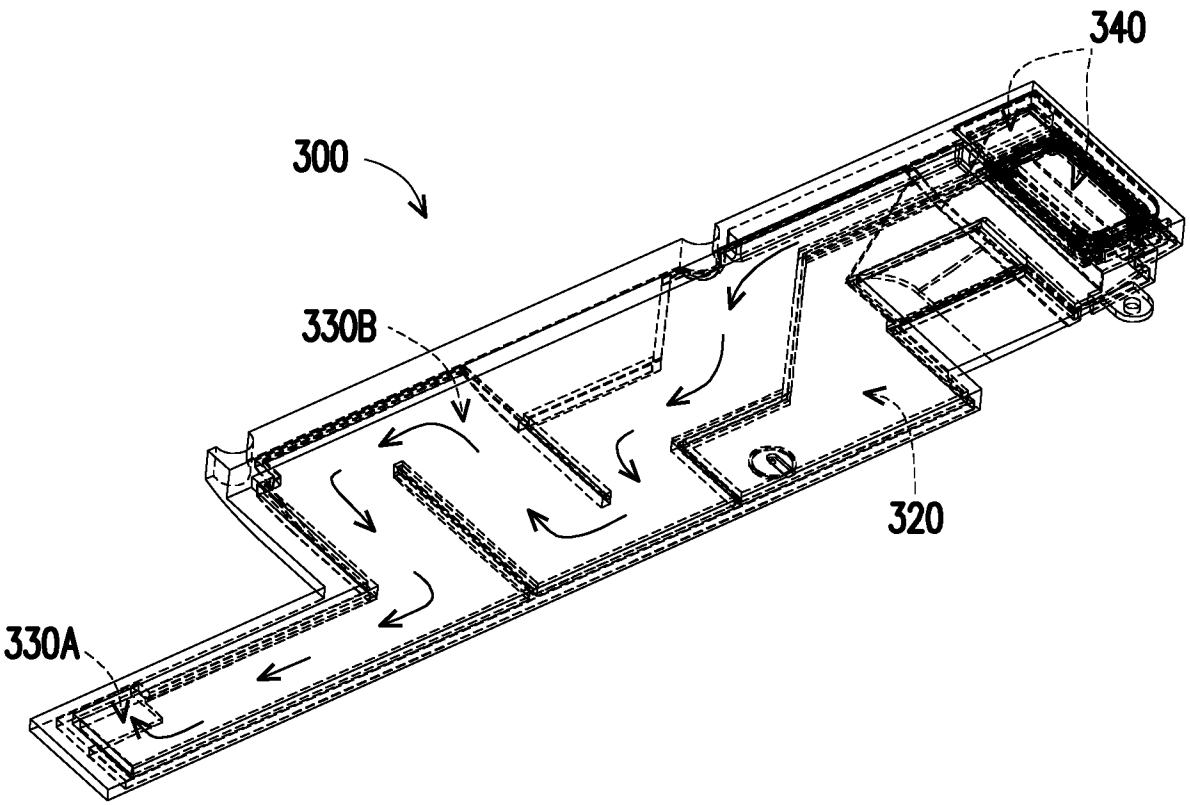
Figure 4B:
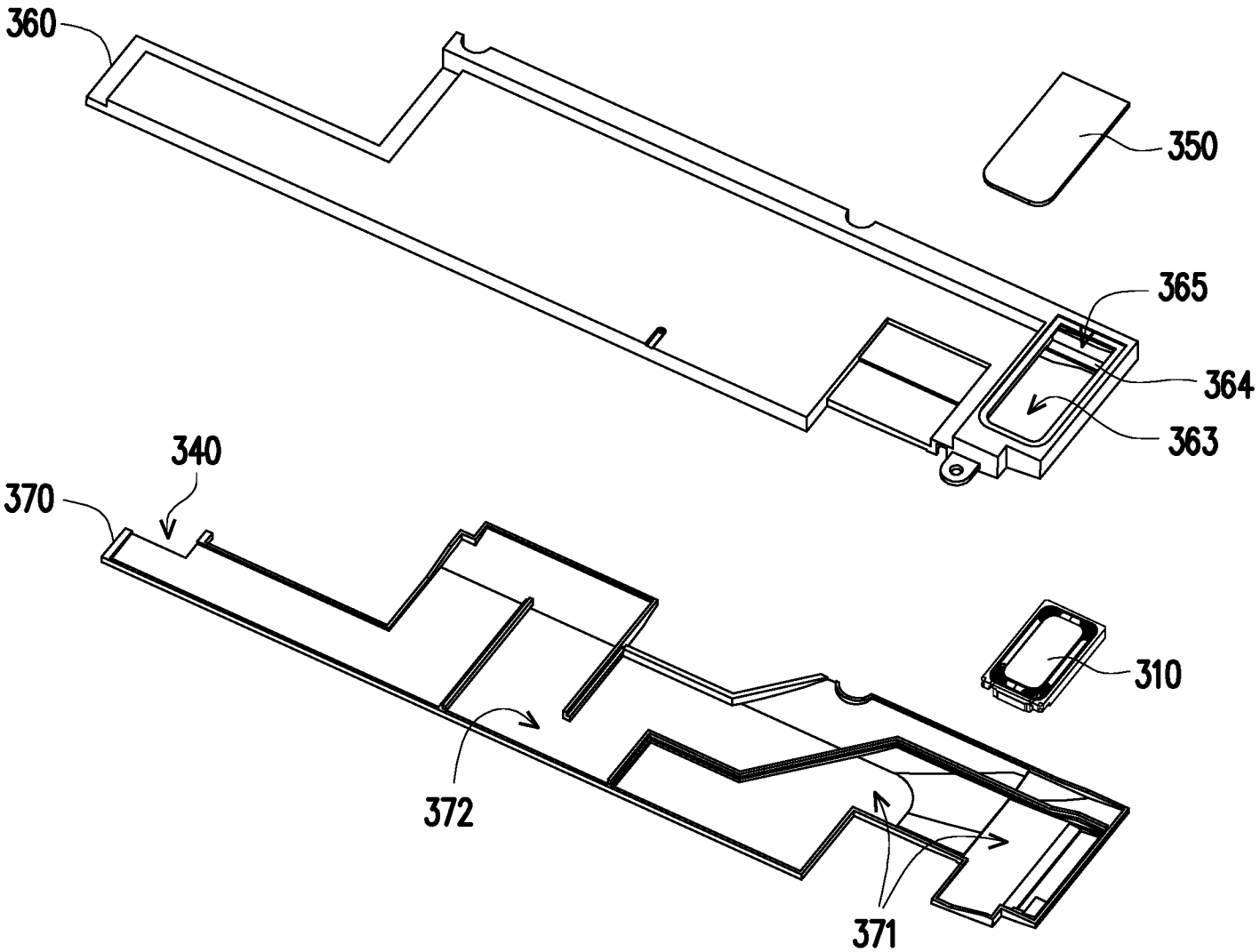
Figure 4C:
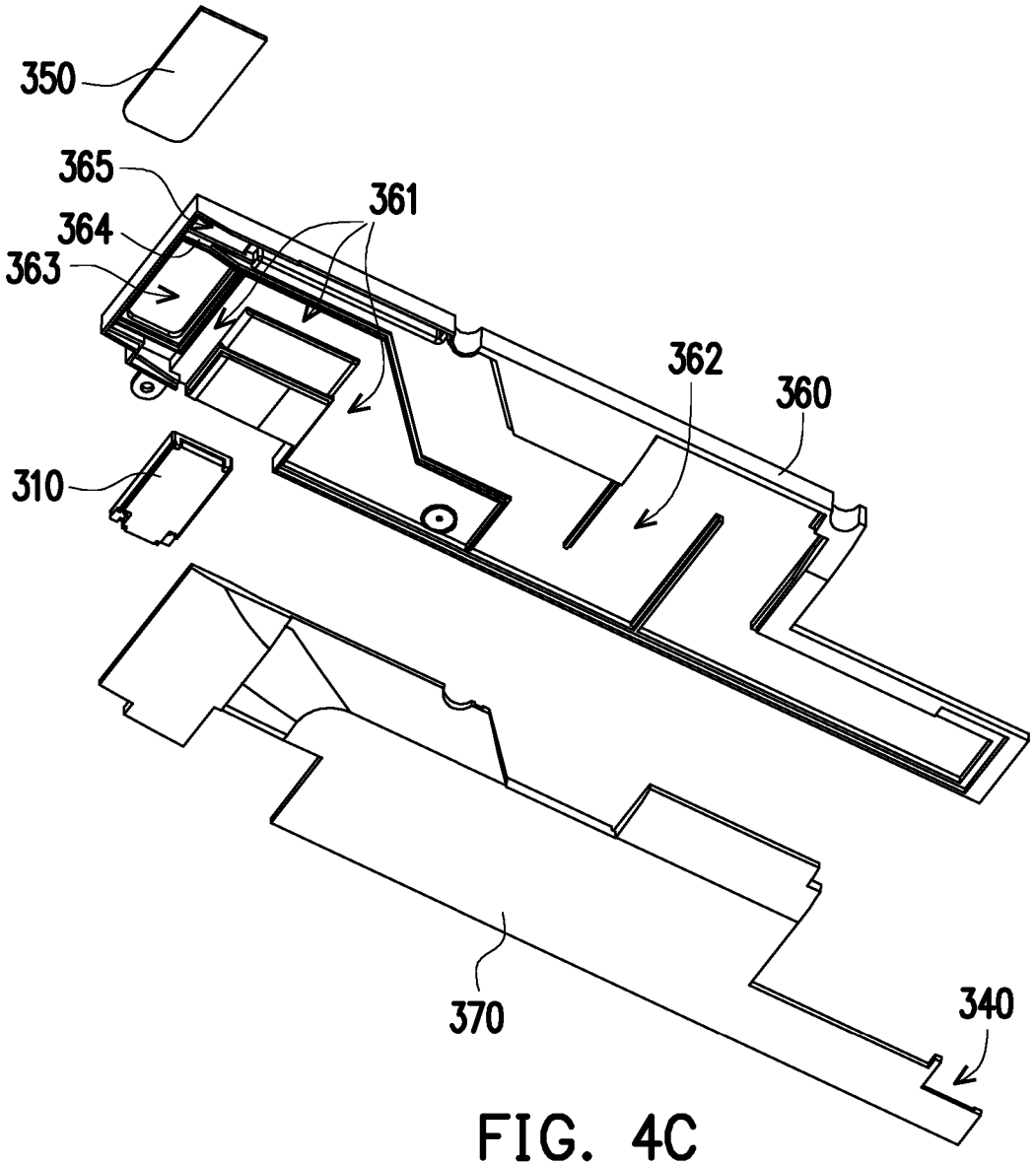
Figure 4D:
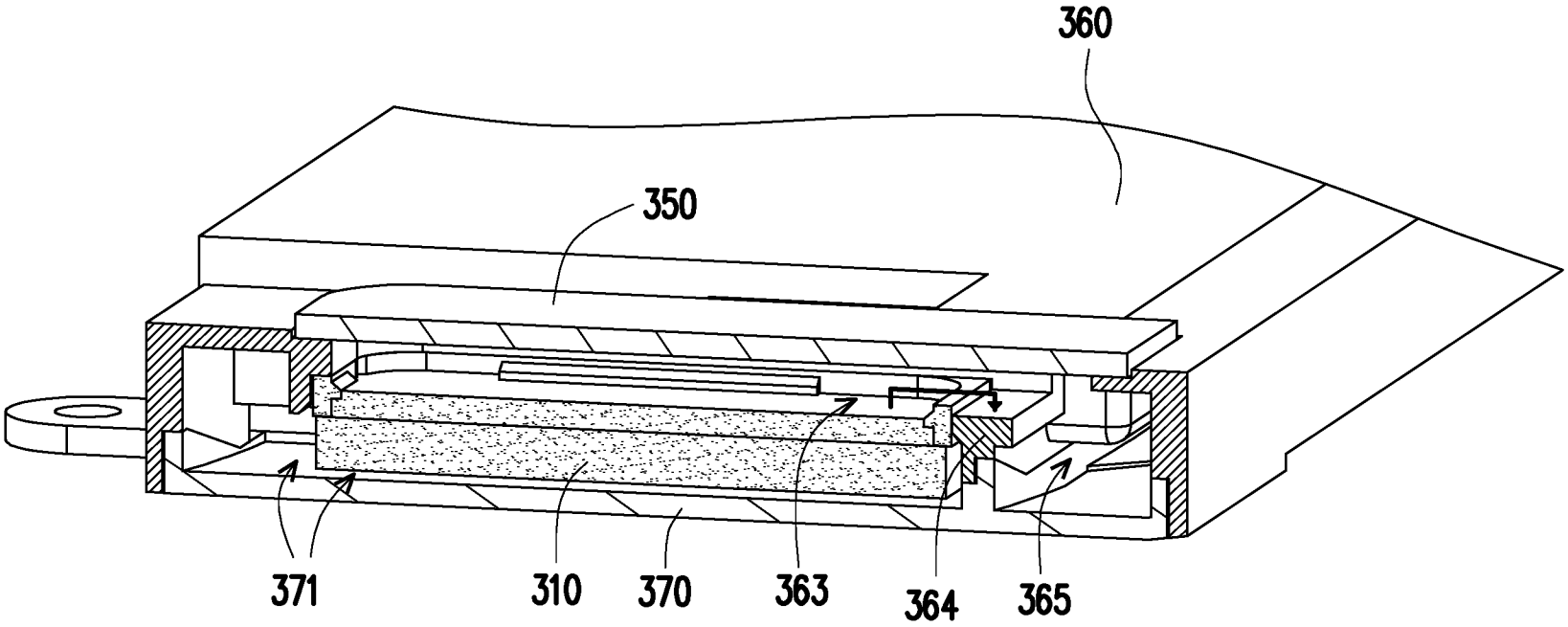

Similar to the schematic views illustrating the decomposed structure in FIGS. 3A to 3D, FIGS. 4B and 4C are views illustrating structural configurations of the extension system 300 of the woofer from different perspectives, and FIG. 4D is a partial cross-sectional view of the extension system 300. In the embodiment, the extension system 300 includes an upper case 360 and a lower case 370, and the woofer 310 is also disposed between the upper case 360 and the lower case 370 and correspond to an opening 363. In addition, a cover plate 350 covers openings 363 and 365, and a space is kept between the cover plate 350 and the woofer 310. Besides, the upper case 360 includes a plurality of sub-spaces 361 and 362, and the lower case 370 includes a plurality of sub-spaces 371 and 372 and a bass hole 340. After the upper case 360 is combined with the lower case 370, the sub-spaces 372 and 362 form the channel 330B. Besides, since the openings 363 and 365 are separated by a rib 364 of the upper case 360, sounds of the woofer 310 may be transmitted from a space corresponding to the opening 363 to a space corresponding to the opening 365 across the rib 364, as shown by arrow signs in FIG. 4D, so as to be from the space 340 to the channel 330B. Accordingly, the front channel is formed. Besides, the sub-spaces 371 and 361 form the space 320, i.e., the rear channel of the extension system.

FIGS. 3A to 3D and FIGS. 4A to 4D shown above merely serve as examples of how the front channel is obtained and serves as the main structure of the extension system 300. However, such examples shall not be construed as limitations on the dimensions and modes of configuration of the extension system.

Figure 6A:
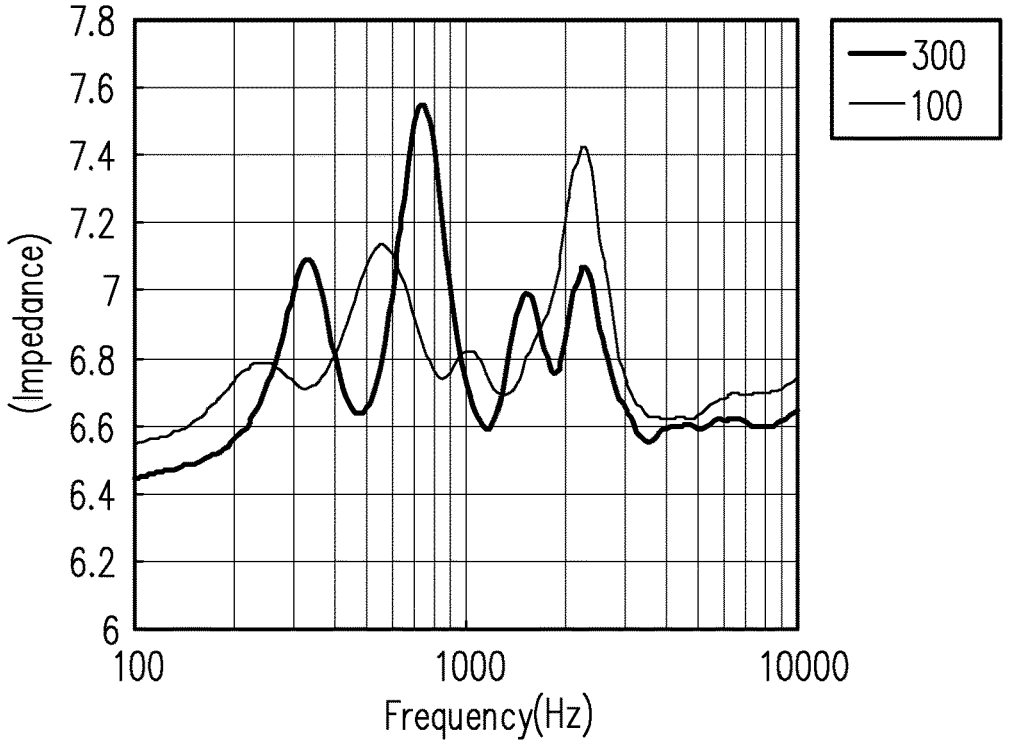
FIG. 6A is a diagram illustrating a relation between frequency and impedance of an extension system.
Figure 6B:
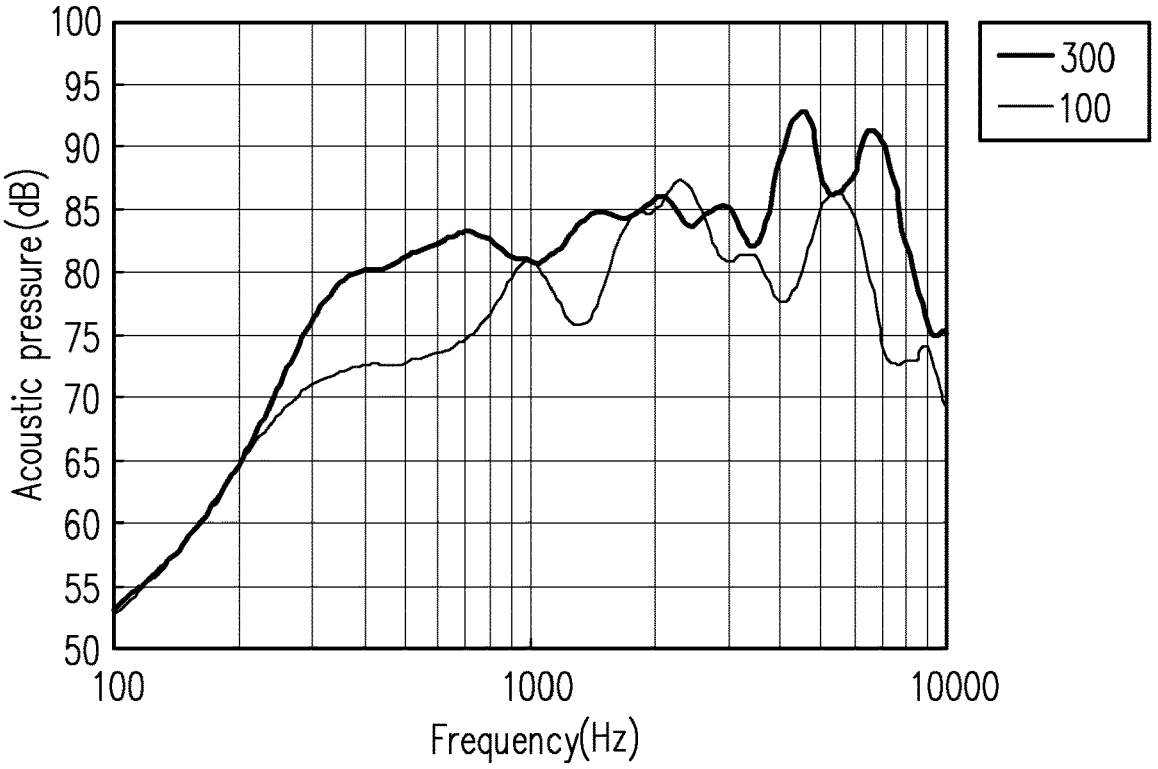
FIG. 6B is a diagram illustrating a relation between frequency and acoustic pressure of an extension system.

FIG. 6A is a diagram illustrating a relation between frequency and impedance of an extension system. FIG. 6B is a diagram illustrating a relation between frequency and acoustic pressure of an extension system. Referring to FIGS. 6A and 6B, as shown in FIG. 6A, a frequency response at 500 Hz or lower is obtained based on the specification of the front channel obtained according to the steps. Therefore, low frequency sounds are generated as expected. Meanwhile, as shown in FIG. 6B, an acoustic pressure at a low frequency (e.g., 500 Hz) also achieves 70 dB or higher, indicating that acoustic waves are able to be transmitted out of the body 10.

Figure 7:
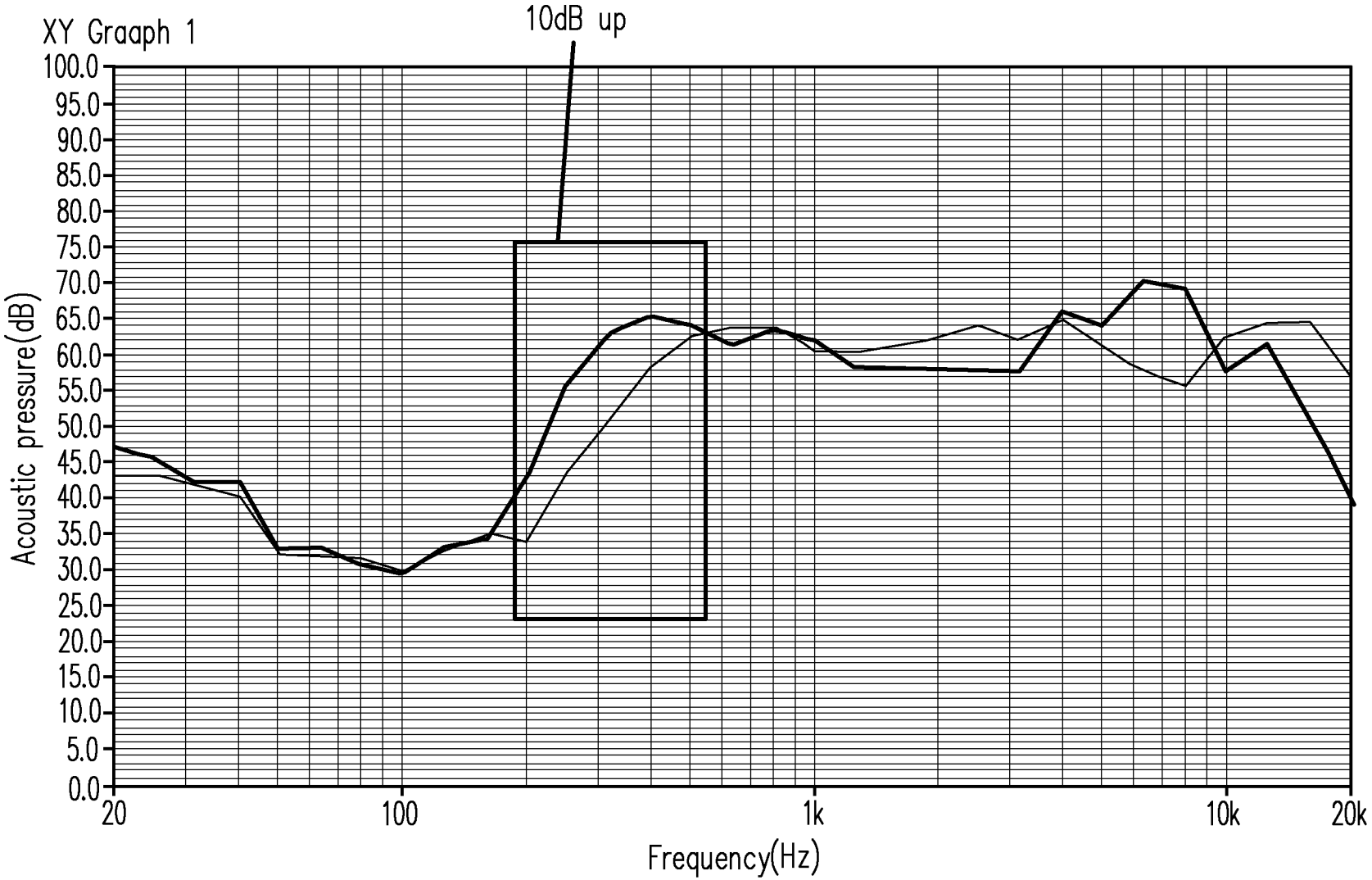
FIG. 7 is a diagram illustrating a relation between frequency and acoustic pressure of an extension system.

FIG. 7 is a diagram illustrating a relation between frequency and acoustic pressure of an extension system. A darker curve in FIG. 7 represents the performance of the extension system 100 of the woofer as an example, and the other curve represents the performance of a known woofer system disposed in a portable electronic device. Taking the low frequency sounds ranging from 200 Hz to 500 Hz shown in the square frame as an example, the extension system 100 of the woofer clearly exceeds the known woofer system by 10 dB or more. Compared to the known art, the extension system of the woofer designed according to the steps are able to certainly demonstrate a woofer sound effect.

In view of the foregoing, in the embodiments of the disclosure, the predetermined space of the extension system of the woofer to be disposed in the electronic device is obtained. Then, according to the embodiments of the disclosure, the cut-off frequency (i.e., the woofer resonant frequency) is computed based on the wave formula of plane waves, and the channel length and the channel cross-sectional area of the extension system are further obtained through computation. In addition, the channel length and the channel cross-sectional area may form the front channel of the extension system in the body of the portable electronic device. Meanwhile, the volume of the rear channel is obtained based on the specification of the woofer, wherein the volume of the front channel is greater than the volume of the rear channel.

Then, the front channel and the rear channel are fit into the device based on the components of the body, so as to accomplish the extension system of the woofer. Accordingly, the extension system of the woofer may still be designed in a portable electronic device, such as a tablet computer, even when the device conditions (e.g., size and arrangement) of the portable electronic device are limited. In other words, even under a critical space usage condition inside the body, the extension system may still be disposed to allow the portable electronic device to play woofer sounds.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A design method of an extension system of a woofer, adapted for a portable electronic device, the design method comprising:

obtaining a predetermined volume required for installing the extension system to the portable electronic device;

computing a cut-off frequency based on the predetermined volume and a wave formula of plane waves;

obtaining a channel length and a channel cross-sectional area of the extension system through the computing; and forming a front channel of the extension system according to the channel length and the channel cross-sectional area, and fitting the extension system into the portable electronic device, wherein computation of the cut-off frequency includes an equation: $fp=[(2m+1)\times C]/4L$, wherein fp represents low-frequency resonant frequency, C represents sound speed, L represents length of a waveguide tube, and m represents mode of vibration.

2. The design method of the extension system of the woofer as claimed in claim 1, wherein the cut-off frequency is greater than or equal to 250 Hz.

3. The design method of the extension system of the woofer as claimed in claim 1, wherein the woofer is a microspeaker, and a power of the microspeaker is less than or equal to 2 w.

4. The design method of the extension system of the woofer as claimed in claim 3, wherein dimensions (length× width) of the microspeaker is 16 mm×9 mm, 32 mm×9 mm, or 34 mm×11 mm.

5. The design method of the extension system of the woofer as claimed in claim 4, further comprising:

setting a volume of a rear channel, wherein the volume of the rear channel corresponding to the dimensions (length×width) of 16 mm×9 mm is 1 c.c, the volume of the rear channel corresponding to the dimensions (length×width) of 32 mm×9 mm is 2 c.c, and the volume of the rear channel corresponding to the dimensions (length×width) of 34 mm×11 mm is 2 c.c.

6. The design method of the extension system of the woofer as claimed in claim 1, further comprising:

setting a rear channel based on a specification of the woofer, wherein the rear channel is a sealed space, and a volume of the rear channel is less than or equal to 3 c.c.

7. The design method of the extension system of the woofer as claimed in claim 1, wherein a body thickness of the portable electronic device is less than or equal to 10 mm.

* * * * *